US010137467B2

(12) United States Patent
Alluigi

(10) Patent No.: US 10,137,467 B2
(45) **Date of Patent: *Nov. 27, 2018**

(54) TRIGGER-DISPENSING DEVICE FOR TWO OR MORE LIQUIDS

(71) Applicant: THE CLOROX COMPANY, Oakland, CA (US)

(72) Inventor: Riccardo Alluigi, Alessandria (IT)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/437,144

(22) Filed: Feb. 20, 2017

(65) Prior Publication Data

US 2017/0157632 A1 Jun. 8, 2017

Related U.S. Application Data

(63) Continuation of application No. 14/683,232, filed on Apr. 10, 2015, now Pat. No. 9,610,598.

(51) Int. Cl.
*B05B 11/00* (2006.01)

(52) U.S. Cl.
CPC ..... *B05B 11/3085* (2013.01); *B05B 11/007* (2013.01); *B05B 11/0078* (2013.01); *B05B 11/3011* (2013.01); *B05B 11/3014* (2013.01); *B05B 11/3025* (2013.01); *B05B 11/3057* (2013.01); *B05B 11/3059* (2013.01); *B05B 11/3069* (2013.01); *B05B 11/3084* (2013.01); *B05B 11/0064* (2013.01)

(58) Field of Classification Search
CPC ..... B05B 11/0064; B05B 11/007; B05B 11/0078; B05B 11/0089; B05B 11/3001; B05B 11/3009; B05B 11/3011; B05B 11/3014; B05B 11/3025; B05B 11/3057; B05B 11/3059; B05B 11/3069; B05B 11/3084; B05B 11/3085
See application file for complete search history.

(56) References Cited

U.S. PATENT DOCUMENTS 4,773,562 A * 9/1988 Gueret ..... A45D 40/24 222/135
5,152,461 A * 10/1992 Proctor ..... B05B 11/0018 222/136

(Continued)

FOREIGN PATENT DOCUMENTS

EP 0449046 A2 10/1991
EP 0449046 A3 10/1991

(Continued)

OTHER PUBLICATIONS

Ministero delle Sviluppo Economico, Rapporto Di Ricerca. Italian Ministry of Economic Development, Search Report. Application No. 10 47377/IT 8S20140085.dated Jan. 7, 2015, Munich.

(Continued)

*Primary Examiner* — Frederick C Nicolas
*Assistant Examiner* — Bob Zadeh
(74) *Attorney, Agent, or Firm* — Erin Collins

(57) ABSTRACT

A trigger head for a dispensing device for at least two substances including a pumping system to compress the substances separately and simultaneously before dispensing.

19 Claims, 10 Drawing Sheets

(56) References Cited

U.S. PATENT DOCUMENTS 5,339,990 A * 8/1994 Wilder ..... B05B 11/3001 222/135
5,398,846 A * 3/1995 Corba ..... B05B 11/0016 222/1
5,570,840 A * 11/1996 Gettinger ..... B05B 7/0433 239/112
5,752,626 A * 5/1998 Bachand ..... B05B 1/3436 222/136
5,839,621 A * 11/1998 Tada ..... B05B 11/0064 222/153.13
5,857,591 A 1/1999 Bachand
5,887,761 A * 3/1999 Foster ..... B05B 11/007 222/383.1
6,869,027 B2 3/2005 Foster et al.
9,610,598 B2 * 4/2017 Alluigi ..... B05B 11/007
2004/0063600 A1 4/2004 Williams et al.
2009/0308897 A1 12/2009 Foster et al.
2011/0272484 A1 11/2011 Richardson et al.
2012/0280065 A1 * 11/2012 Foster ..... B05B 11/0008 239/375
2013/0202484 A1 8/2013 Green
2014/0061233 A1 3/2014 Lang et al.
2015/0298149 A1 * 10/2015 Alluigi ..... B05B 11/007 222/135
2015/0352575 A1 * 12/2015 Dring ..... B05B 11/3084 222/137
2015/0375245 A1 12/2015 Burrowes et al.
2016/0228899 A1 * 8/2016 Gonzalez ..... B05B 11/3084
2017/0121653 A1 * 5/2017 Hoefte ..... C11D 11/0023
2017/0157632 A1 * 6/2017 Alluigi ..... B05B 11/007

FOREIGN PATENT DOCUMENTS

EP 0803295 A2 10/1997
EP 10043648 2/1998
EP 2000135457 5/2000
EP 2009125700 6/2009
JP 10-43648 2/1998
JP 2000135457 A 5/2000
JP 2009-125700 6/2009
WO 9831470 A1 7/1998

OTHER PUBLICATIONS

U.S. Consumer Product Safety Commission, retrieved from the Internet: http://www.cpsc.gov/pagefiles/115095/gualadispensing.pdf (retrieved on Jun. 28, 2016).

* cited by examiner

TRIGGER-DISPENSING DEVICE FOR TWO OR MORE LIQUIDS

CROSS-REFERENCE TO RELATED APPLICATIONS

This application is a continuation of and claims priority to U.S. Non-provisional application entitled "TRIGGER-DISPENSING DEVICE FOR TWO OR MORE LIQUIDS": having the Ser. No. 14/683,232, filed Apr. 10, 2015, which claims priority to Italian Patent Application serial number BS2014A000085, entitled: "TRIGGER-DISPENSING DEVICE FOR TWO OR MORE LIQUIDS": filed Apr. 18, 2014, which are herein incorporated by reference in their entirety.

BACKGROUND

Technical Field

This invention refers to a manual trigger-dispensing device for liquids for at least two substances, generally liquids, for example for the hygiene of the home, the deodorization of rooms, the treatment of fabrics before ironing, and the like.

Description of the Related Art

Trigger devices are very widespread, as can be seen on supermarket shelves, especially for their ease of use and functionality. Every year many hundreds of millions of pieces are produced.

Among the numerous types, there are devices for two or more substances, particularly appreciated in applications such as hygiene of the home. In fact, it was found that the combination of several substances provides accentuated action, for example sanitizing, if the combination takes place shortly before dispensing from the device or even if the combination is realized on the surface itself.

There are numerous trigger-dispensing device solutions for two or more substances.

However, the solutions of the prior art sometimes have the drawback of not achieving a good mixture of the substances to be combined, frustrating, as was said above, the main purpose of this type of devices.

SUMMARY OF THE DISCLOSURE

The purpose of this invention is to provide a trigger-dispensing device for two or more substances that meets the needs of the sector and overcomes the drawbacks referred to above.

This purpose is achieved by a trigger head of a trigger device, wherein the head comprises a trigger and pumping means operable by the trigger to aspirate simultaneously at least two substances and achieve dispensing, wherein the means for pumping are in addition suitable for carrying out a predetermined pre-compression of these substances, separately and simultaneously before dispensing.

DETAILED DESCRIPTION

Figure 1:
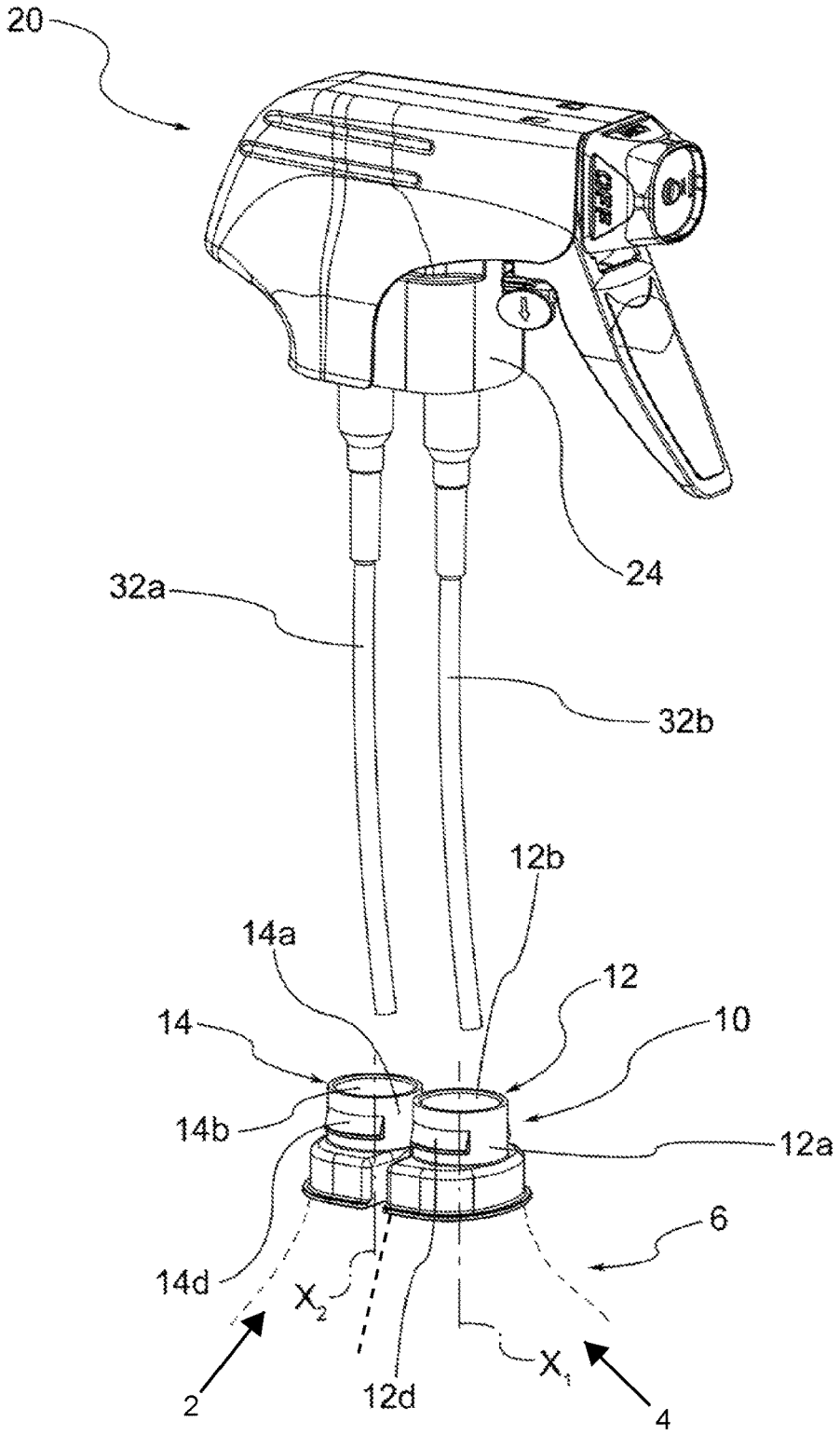
FIG. 1 is a trigger-dispensing device for two substances according to an embodiment of this invention, comprising a dispensing head and a bottle (shown separately in the figure)
Figure 2:
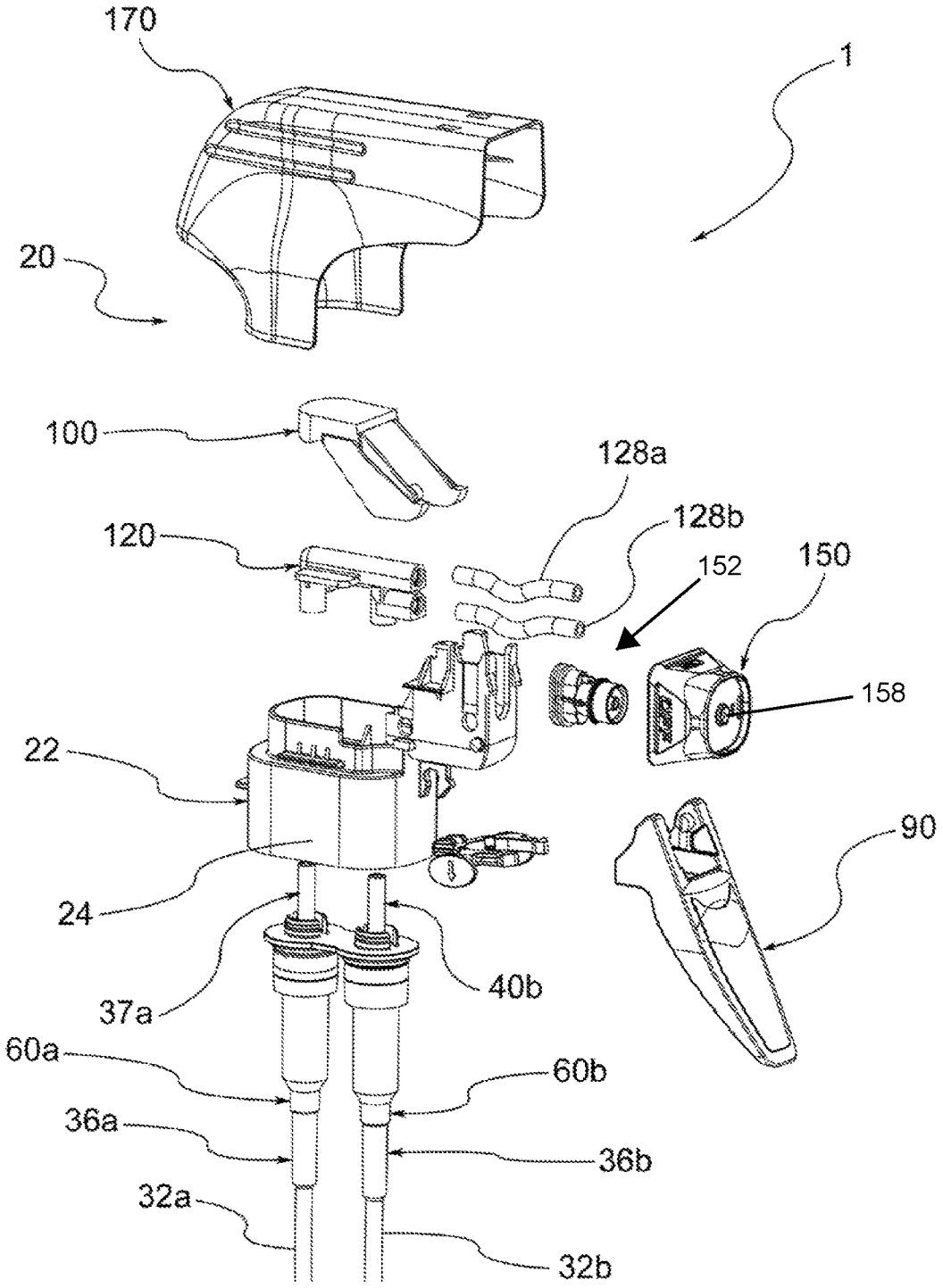
FIG. 2 is the dispensing head of the device of FIG. 1, with parts separated.
Figure 3:
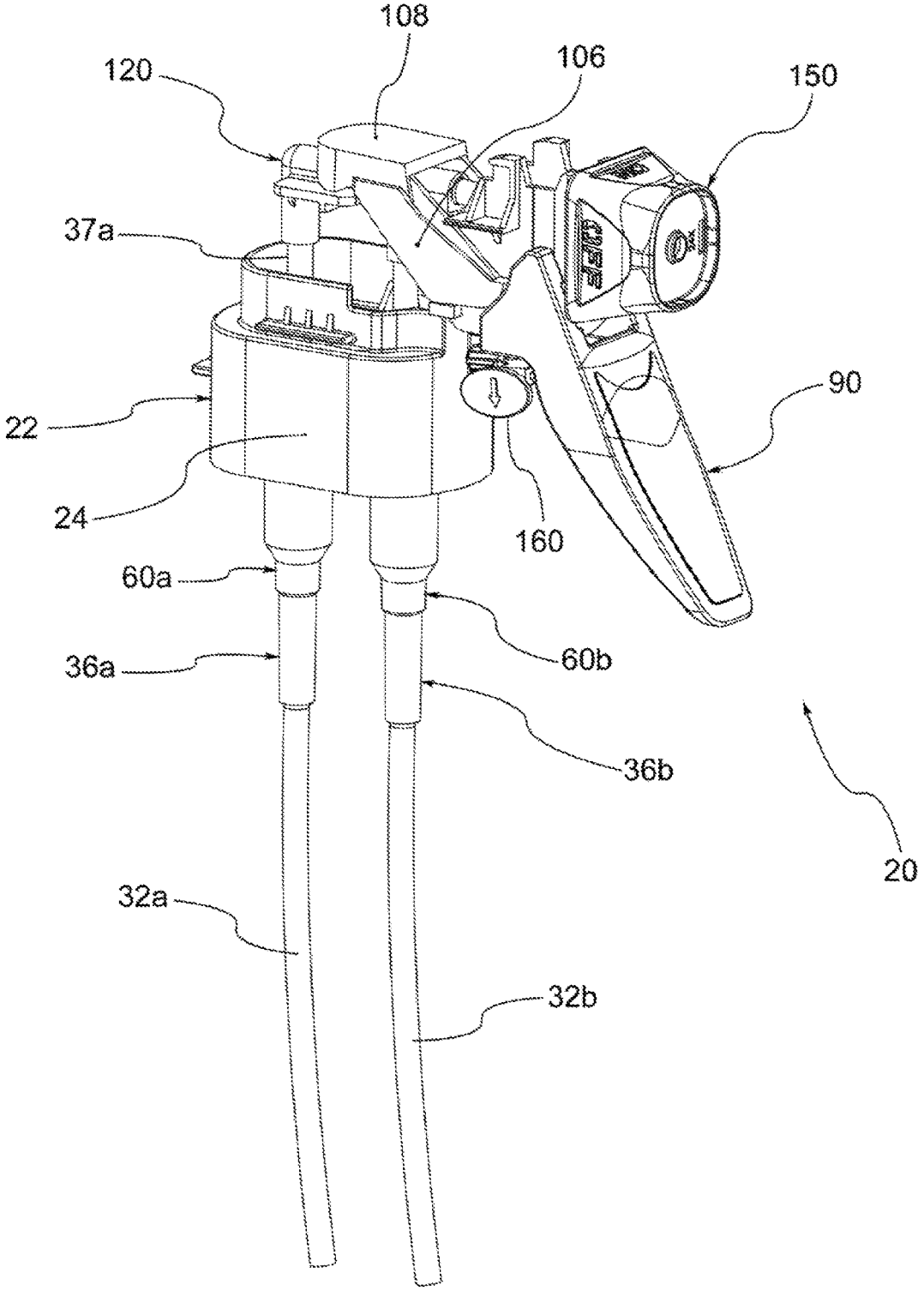
FIG. 3 illustrates the dispensing head according to a front view.
Figure 4:
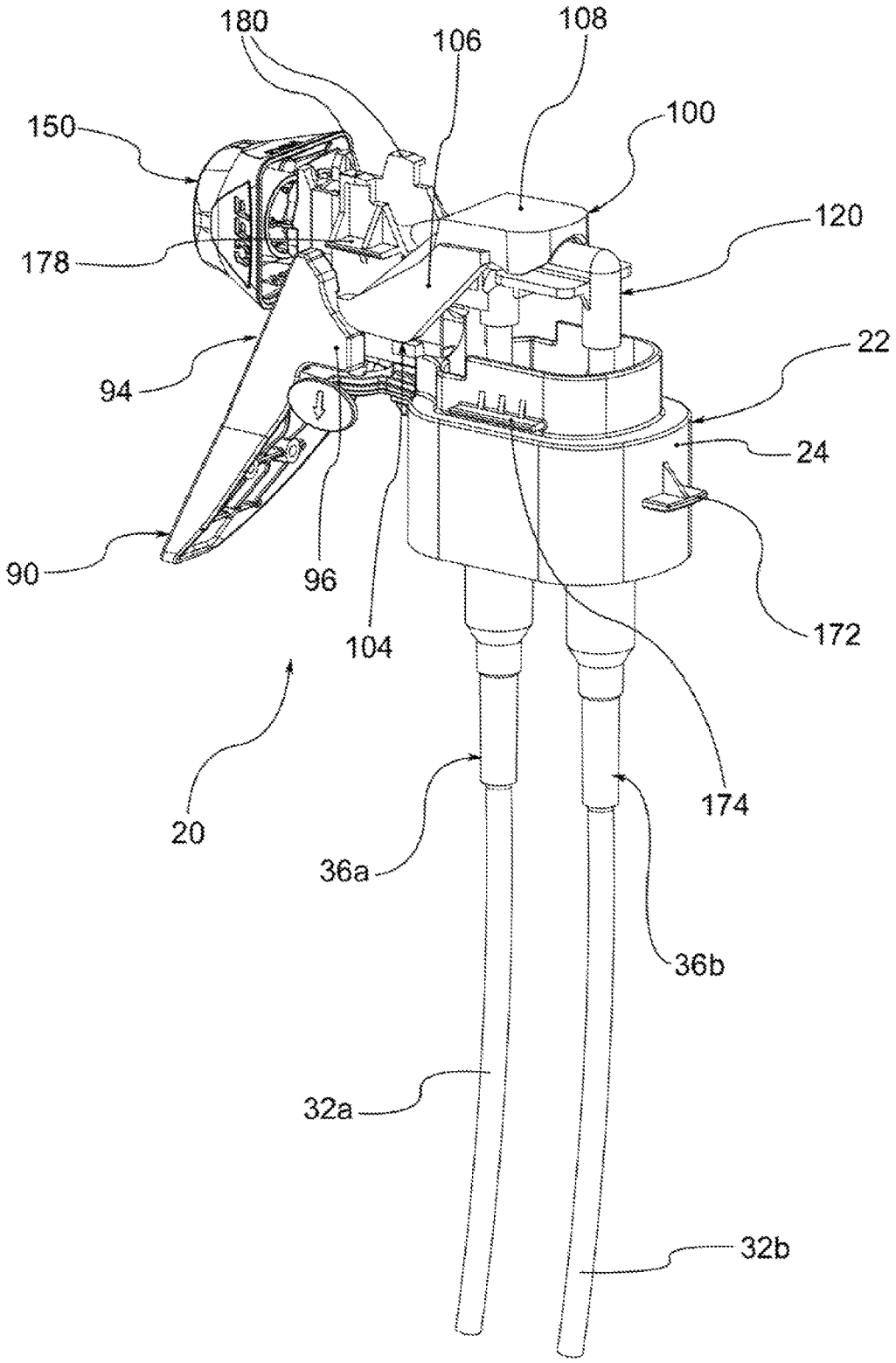
FIG. 4 illustrates the dispensing head according to a rear view.

With reference to the accompanying, 1 generally indicates a trigger dispensing device for two or more substances, generally liquids before dispensing.

For clarity of exposition, hereinafter we will refer to variants of the invention for two substances, without precluding the extension of the innovative features to more than two substances.

The device 1 comprises a first containment compartment and a second containment, separated from each other, respectively for the containment of a first substance and a second substance, usually liquids.

For example, the device 1 comprises a bottle 6 made in a single piece, for example of plastic, provided internally with a partition wall that separates the two containment compartments.

Preferably, the bottle 6 includes a bottle coupling portion 10 for the attachment of a pre-assembled dispensing head 20.

For example, the bottle coupling portion 10 includes a first neck 12 and a second neck 14, comprising respective annular neck walls 12*a*, 14*a*, for example cylindrical, that define respective rectilinear coupling axes X1,X2, parallel to each other.

The neck walls 12*a*,14*a* define respective openings 12*b*, 14*b* for access to the respective containment compartments.

Preferably, the dispensing head 20 can be snap-coupled to the bottle 6.

For example, the coupling portion includes fins for snap coupling; for example, each neck 12, 14 comprises coupling fins 12*d*,14*d*, protruding outward from the respective neck wall 12*a*,14*a*.

For example, the coupling fins form two pairs, one for each neck 12,14; preferably, the fins of each pair have the same angular extension and are arranged symmetrically protruding from the neck, with respect to an imaginary plane containing the two coupling axes X1,X2.

The dispensing head 20 is preferably pre-assembled and applied to the bottle 6 after filling of the bottle with the substances to be dispensed.

The head 20 comprises a frame or chassis 22 for the support of the components. Preferably, the frame 22 can be snap-coupled to the bottle 6.

For example, the frame 22 comprises an annular coupling head wall 24 suitable to externally surround the necks 12, 14 of the bottle, provided with counter-coupling fins for snap engagement with the fins 12*d*,14*d* of the necks 12,14.

The head 20 comprises pumping means suitable to operate to simultaneously achieve the suction and pre-compression of two or more substances, and the separate or combined dispensing of the substances.

The pumping means comprise a first pressure chamber 30*a* and a second pressure chamber 30*b* suitable to be placed in communication respectively with the first containment compartment and the second containment compartment of the bottle 6, through respective inlet openings 31*a*,31*b*, for example by means of respective tubes 32*a*,32*b* applied to the inlet openings 31*a*,31*b*.

Furthermore, the head 20 comprises a first dispensing duct 40*a* and a second dispensing duct 40*b* for the dispensing of the substances from the respective pressure chambers 30*a*,30*b*.

The pumping means further comprise a first piston 34*a* and a second piston 34*b* suitable to operate in the respective pressure chambers 30*a*,30*b* to pressurize the substances contained therein, for example, for translation along respective piston axes Y1,Y2.

Preferably, each piston 34*a*,34*b* comprises a piston head 35*a*,35*b* and a piston rod 37*a*,37*b*, that extend along the respective piston axes Y1,Y2 and that support the respective piston heads 35*a*,35*b*.

Furthermore, the pressure means comprise suction valve means suitable to allow the transit of a substance from a respective containment compartment 2,4 of the bottle to the respective pressure chamber 30*a*,30*b* during a suction phase and prevent the return of the substance from the respective pressure chamber 30*a*,30*b* to the respective containment compartment 2,4 during a pre-compression step.

For example, the suction valve means comprise a first check valve 36*a*, positioned between a first inlet opening 31*a* and the first pressure chamber 30*a*, and a second check valve 36*b*, positioned between a second inlet opening 31*b* and the second pressure chamber 30*b*.

According to an embodiment, the check valves 36*a*,36*b* comprise an obturator 38*a*,38*b*, sensitive to the action of the substance present in the pressure chamber 30*a*,30*b*, for example in the form a ball, and an obturator seat.

In addition, the pumping means comprises pre-compression valve means suitable to allow the passage of substances from respective pressure chambers 30*a*,30*b* to the respective delivery ducts 40*a*,40*b* when the pressure of the substances in the pressure chambers exceeds a predefined threshold pressure and suitable to prevent the transit of the substances from the respective pressure chambers 30*a*,30*b* to the respective delivery ducts 40*a*,40*b* when the pressure of the substances in the pressure chambers is less than a predefined threshold pressure.

Preferably, the pressure threshold is greater than 1 bar; more preferably, the pressure threshold is greater than 3 bar.

For example, the pre-compression valve means comprise a first pre-compression valve 42*a*, operating between the first pressure chamber 30*a* and the first delivery duct 40*a*, and a second pre-compression valve 42*b*, operating between the second pressure chamber 30*b* and the second delivery duct 40*b*.

For example, the pre-compression valves 42*a*,42*b* each comprise an obturator plate 44*a*,44*b*, a piston head body 46*a*,46*b*, a pre-compression spring 48*a*,48*b* (which presses on the piston head body 46*a*,46*b*) and a return spring 50*a*,50*b* (which presses on the obturator plate 44*a*,44*b*).

In the step of simultaneous pre-compression of the substances, the pre-compression spring 48*a*,48*b* and the return spring 50*a*,50*b*, which work in an antagonistic manner, hold integral between them the obturator plate 44*a*,44*b* and the piston head body 46*a*,46*b*, closing the access of the pressure chamber 30*a*,30*b* to the respective delivery duct 40*a*,40*b*.

The assembly formed by the obturator plate 44*a*,44*b* and the piston head body 46*a* operates from the piston head 35*a*,35*b*, which compresses the substance in the pressure chamber 30*a*,30*b*.

The action of the piston 34*a*,34*b* produces a pressure increase in the pressure chamber 30*a*,30*b*, until the predetermined threshold pressure is exceeded.

Since the pre-compression spring 50*a*,50*b* works in opposition to the action of the pressure in the pressure chamber 30*a*,30*b*, upon reaching the threshold pressure, the piston head body 46*a*,46*b* separates from the obturator plate 44*a*, 44*b*, opening the access to the respective delivery duct 40*a*,40*b*, simultaneously for the two substances.

Preferably, the pumping means comprise a first hollow casing 60*a* and a second hollow casing 60*b*, having prevailing extension along the respective piston axes Y1,Y2.

Inside each casing 60*a*,60*b*, the pressure chamber 30*a*,30*b* is formed, the piston 34*a*,34*b* is operating, for example, slidingly, and the check valve 36*a*,36*b* and the pre-compression valve 42*a*,42*b* are housed.

Preferably the head 20 comprises a connecting flange 70 for the simultaneous connection of the two casings 60*a*,60*b* to the frame 22.

The casings 60*a*,60*b* are applied to the flange 70, which is, in turn, affixed to the frame 22, and from the flange the piston rods 37*a*,37*b* protrude axially.

Furthermore, the head 20 comprises a trigger 90 hinged to the frame 22 at a trigger-connection point 90, and actuation means, operable from the trigger 90, for the simultaneous activation of the pistons 34*a*,34*b*.

In a preferred embodiment, the actuation means comprise a transmission member 100, hinged to the frame 22 at a pivot point 102, engageable by the trigger 90, so that a rotation of the trigger 90 corresponds to a counter-rotation of the transmission member 100.

Figure 5:
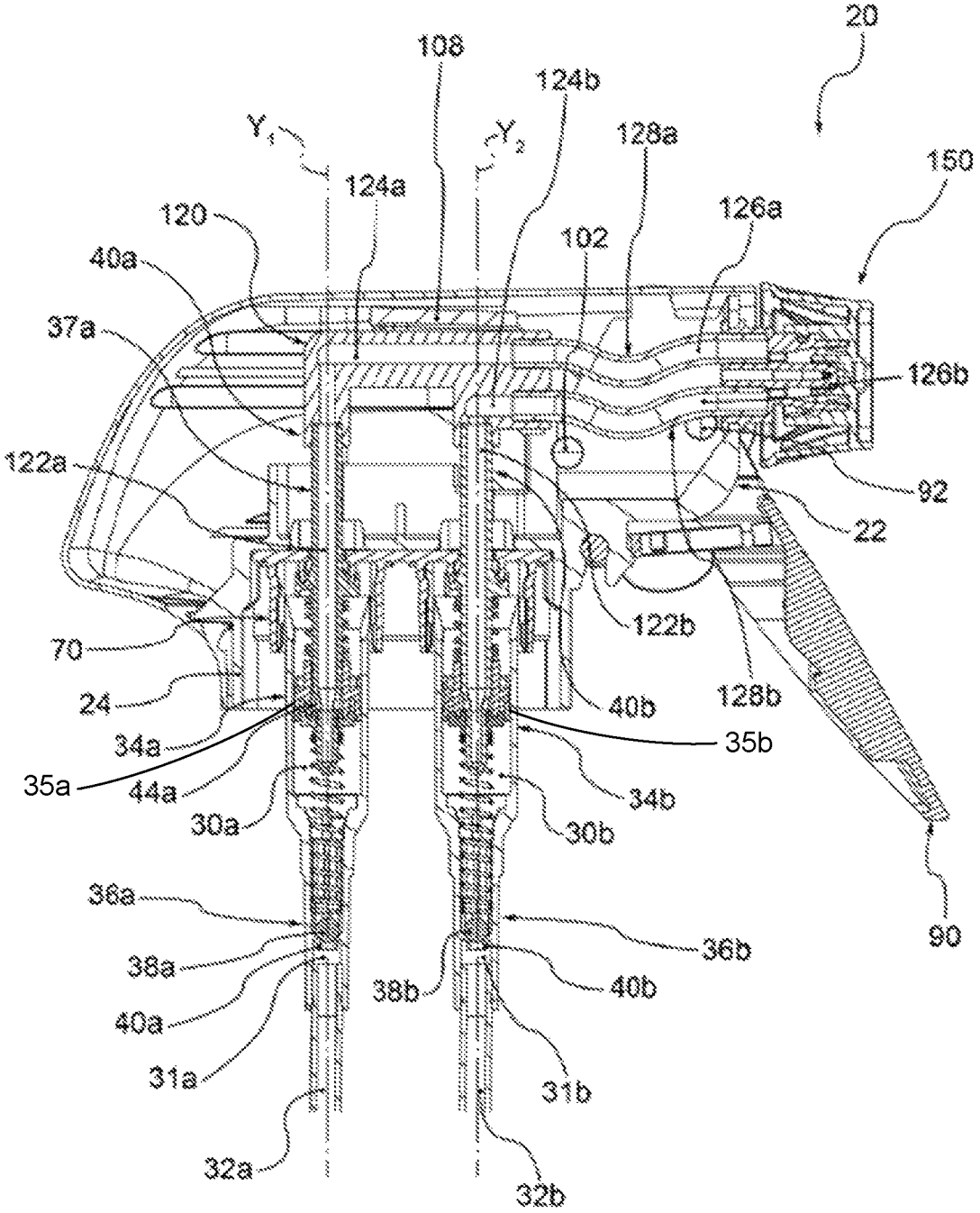
FIG. 5 shows a sectional view of the dispensing head.
Figure 6:
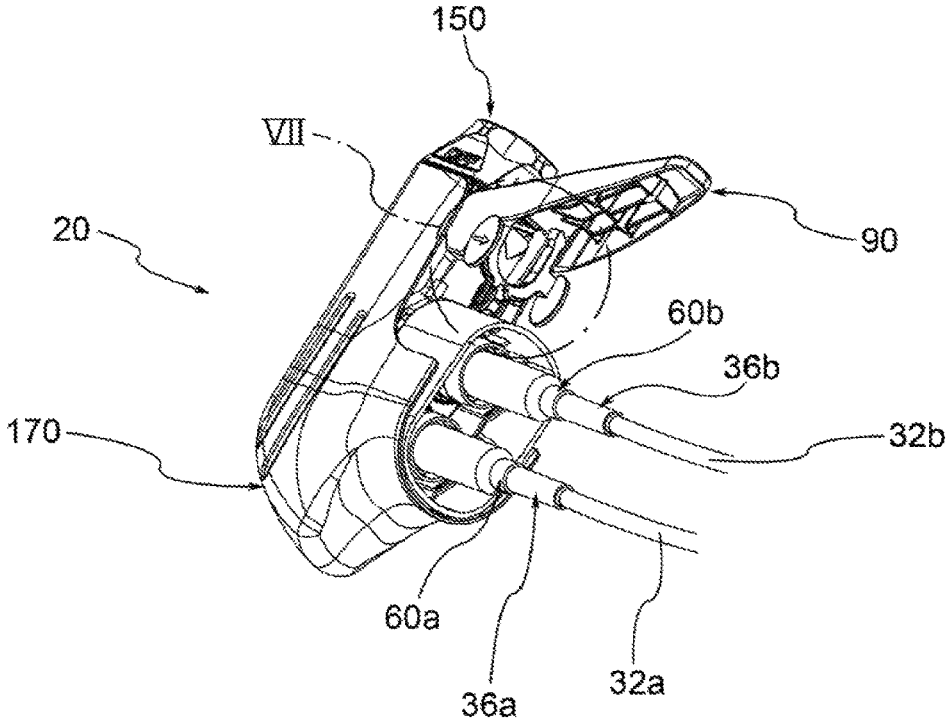
FIG. 6 illustrates the dispensing head according to a further observation point.
Figure 7:
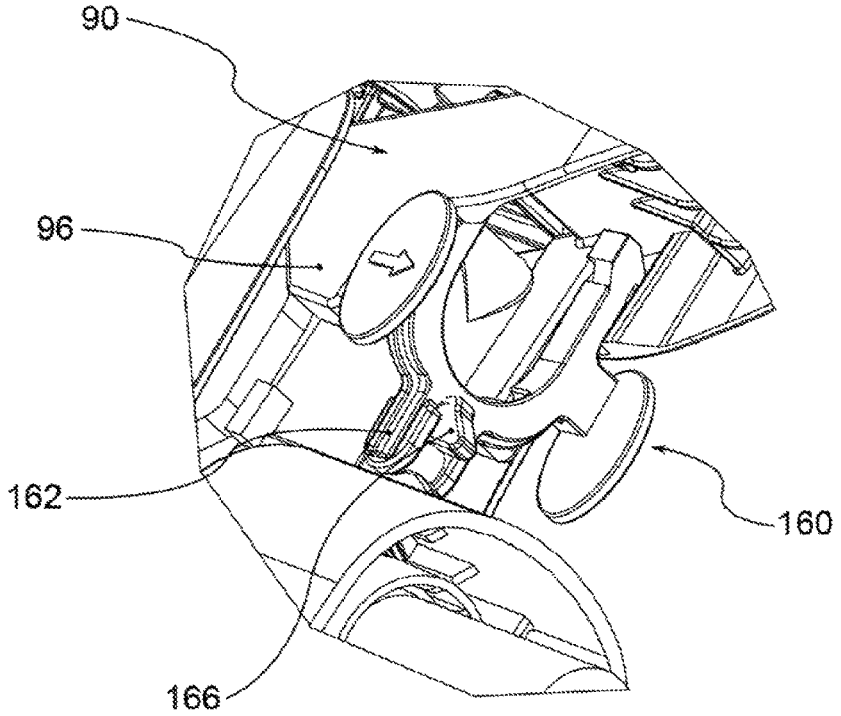
FIG. 7 shows an enlargement of detail VII in FIG. 6.
Figure 8:
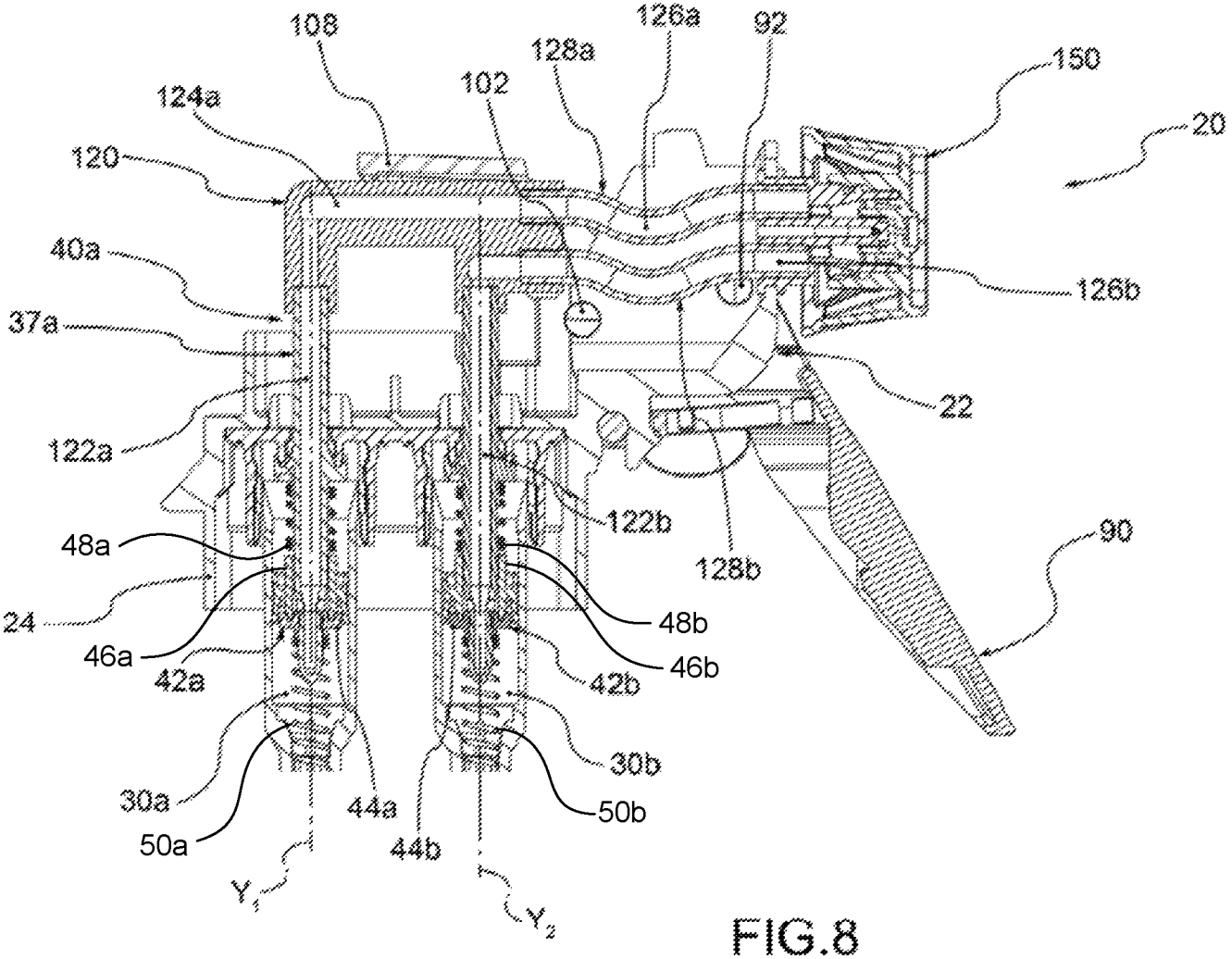
FIG. 8 shows a sectional view of the dispensing head of FIG. 5, without cover.
Figure 9C:
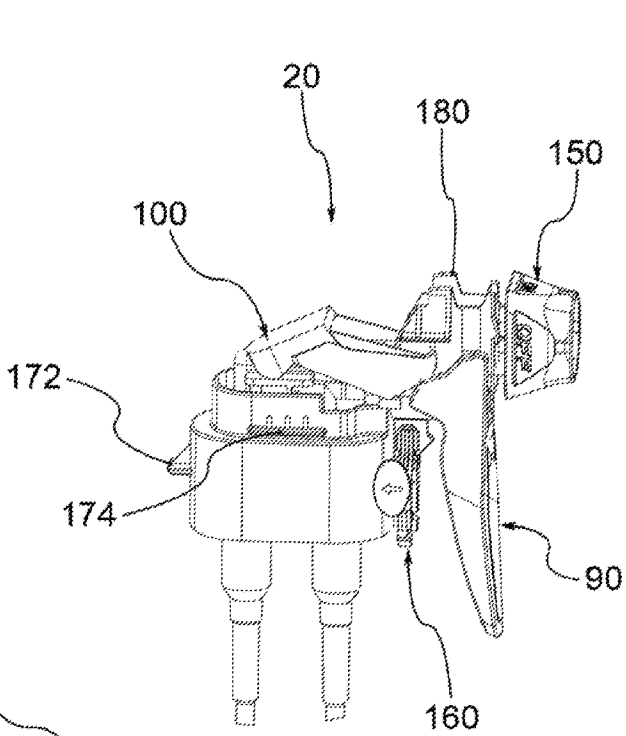
FIGS. 9*a* to 9*c* illustrate the dispensing head, respectively, in a locked configuration, an unlocked and partially actuated configuration and in a final actuated configuration.
Figure 9B:
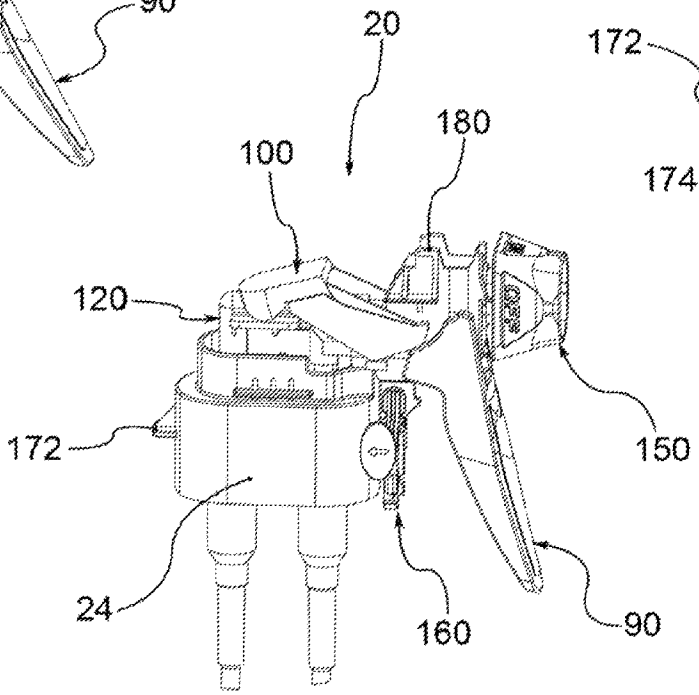
Figure 9A:
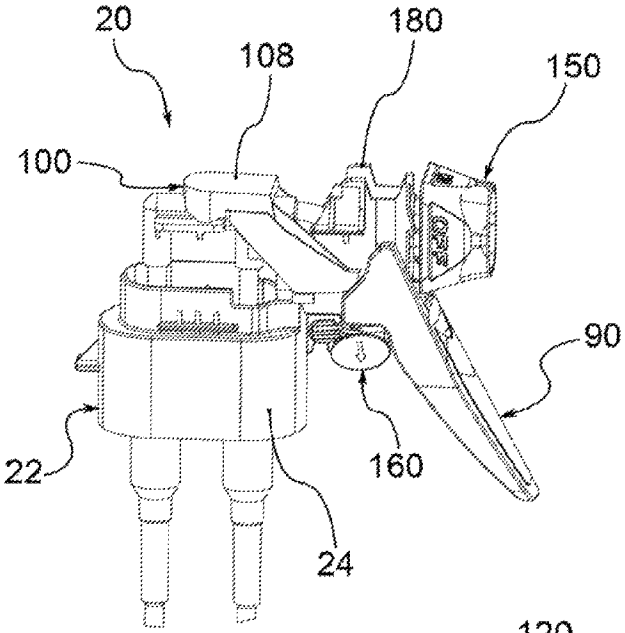
Figure 10:
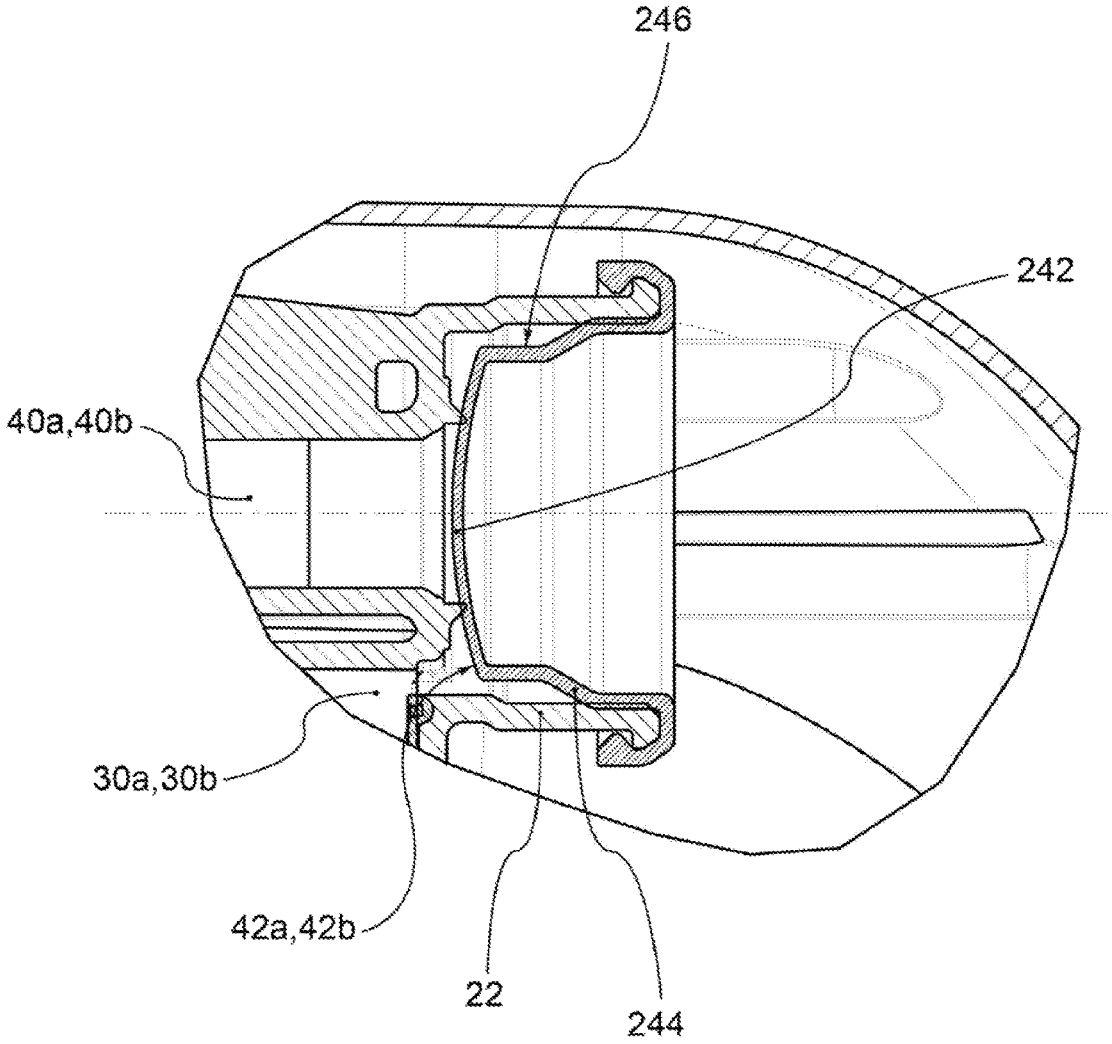
FIG. 10 shows a pre-compression valve of the dispensing head according to a further embodiment of the invention.

In particular, having defined an imaginary plane containing the two pistons axes Y1,Y2, for the head 20 (and for the device 1), a right side is defined by one part of the imaginary plane, and a left side by the other part. Preferably, the imaginary plane so defined intersects the trigger 90. For example, as illustrated in FIG. 5, a first axis of a first pump can be positioned behind a second axis of a second pump and in the same plane.

Preferably, the trigger 90 comprises a trigger engagement portion 94 for engagement with the transmission member 100, wherein the portion 94 includes two protrusions 96, one on one side and one on the other side of the head.

Similarly, the transmission member 100 comprises an engagement organ portion 104 for engagement with the trigger 90, wherein the portion 104 comprises two elongations 96, one on one side and one on the other side of the head.

The transmission member 100 also includes a main portion 108, straddling between the sides of the head 20, from which protrude the elongations 106, due to the simultaneous action on the pistons 34*a*,34*b*.

Moreover, the actuation means comprise, preferably, an intermediate body 120, engageable by the transmission member 100 and suitable to translate along the pistons axes Y1,Y2.

The two pistons 34*a*,34*b*, and in particular the two piston rods 37*a*,37*b*, are integrally connected to the intermediate body 120.

In other words, the rotation of the trigger 90, for example clockwise, by manual action of a user of the device 1, causes the counter-rotation, for example counter-clockwise, of the transmission member 100, that goes to push the intermediate body 120, to which are integrally connected the two pistons 34*a*,34*b*, which are so actuated in compression.

According to a preferred embodiment, as shown, the delivery ducts 40*a*,40*b* pass through the piston rods 37*a*,37*b* and the intermediate body 120.

In particular, each delivery duct 40*a*,40*b* includes an initial section 122*a*,122*b* that extends inside the respective piston rod 37*a*,37*b*, an elbow section 124*a*,124*b* that extends inside the intermediate body 120, and an end section 126*a*, 126*b* that extends in extensible tubes 128*a*,128*b* sealingly applied to the intermediate body 120, up to a nozzle group 150 applied to the frame 22. For example, as illustrated in FIG. 5, elbow sections 124*a* and 124*b* can have different lengths, thus delivery ducts 40*a* and 40*b* can have different lengths.

The extensible tubes 128*a*,128*b* are suitable to compensate for the variation of position between the intermediate body 120 and the nozzle group 150 due to the movement undergone by the intermediate body 120 during the pre-compression step with respect to the nozzle group 150, which remains fixed.

For example, the tubes 128*a*,128*b* have an over-abundant length or are made of extensible material.

For example, the tubes 128*a*, 128*b* are made of plastic, for example low-density polyethylene (LDPE) or polyvinyl chloride (PVC).

According to a preferred embodiment, the first delivery duct 40*a* and the second delivery duct 40*b* flow into a mixing chamber 152 inside the head 20.

For example, the nozzle group 150 comprises a mixing chamber 152 into which the delivery ducts 40*a*,40*b* enter, and in particular their end sections 126*a*,126*b*.

For example, the mixing chamber 150 is formed in a nozzle body 154 applied to the frame 22, to which are sealingly applied the two flexible tubes 128*a*,128*b*.

Additionally, the nozzle group 150 compress a nozzle mask 156 having a dispensing opening 158 in communication with the mixing chamber 152, administered in a manner rotatable by a user to the nozzle body 154, for example in order to close the dispensing opening 158 by rotation.

According to further variant embodiments, the delivery ducts each comprise a respective dispensing opening for the simultaneous and separate dispensing the two substances to the outside.

Furthermore, the head 20 preferably comprises removable locking means suitable to prevent accidental actuation of the trigger.

For example, the locking means comprise a removable latch 160, suitable to be placed between the frame 22 and the trigger 90 to prevent the actuation of the trigger 90.

For example, the latch 160 is hinged to the frame 22 in a latch hinging point 162 and presents an anchoring portion 164 suitable to couple itself to a protrusion 166 of the frame 22.

Preferably, the latch 160 and the trigger 90 can be snap-coupled to each other.

In a locked configuration, the latch 160 is in an angular position in which it obstructs the actuation of the trigger 90 and the anchoring portion 164 is coupled to the protrusion 166 of the frame, so that the latch 160 stably maintains the position.

Preferably, in the configuration, the latch 160 is snap-coupled with the trigger 90.

For rotation by a user, the anchoring portion 164 disengages from the protrusion 166 (and preferably the latch 160 and the trigger 90 release the mutual snap coupling) and the latch 160 is brought into an angular position in which it does not obstruct the actuation of the trigger 90.

The head 20 further comprises a cover 170, snap-coupleable to the frame 22.

In particular, the frame 22 comprises a rear fin 172, projecting externally from the coupling head wall 24 on the part opposite the trigger 90, the side fins 174, projecting from one side and the other of the frame 22, above the coupling head wall 24, and front side fins 178,180, projecting from one side and the other of the frame 22 in the vicinity of the nozzle group 150, all snap-coupled with the cover 170.

Innovatively, the device according to this invention meets the needs of the sector, since it achieves an excellent mixing of the two substances thanks to the separate and simultaneous compression of both substances immediately before being combined with each other.

In other words, the pre-compression of the two substances prior to their combination, makes the mixing particularly effective, both in the event that it takes place in a mixing chamber inside the device and when it takes place on the object to be treated, for example a surface to be cleaned.

Advantageously, moreover, the assembly of the device is particularly fast and efficient, thanks to the snap connection between the head and the bottle. This advantage is especially appreciated in the sector, given the enormous volume of production.

According to a further advantageous aspect, the device is very reliable, thanks to the robust mechanism which ensures the actuation of the pistons in response to the actuation of the trigger.

Advantageously, moreover, the application of the dispensing head to the bottle is particularly fast, to the advantage of high-volume production.

According to further embodiments, the check valves comprise a flexible membrane deformable by the action of the pressure in the pressure chamber.

Figure 11:
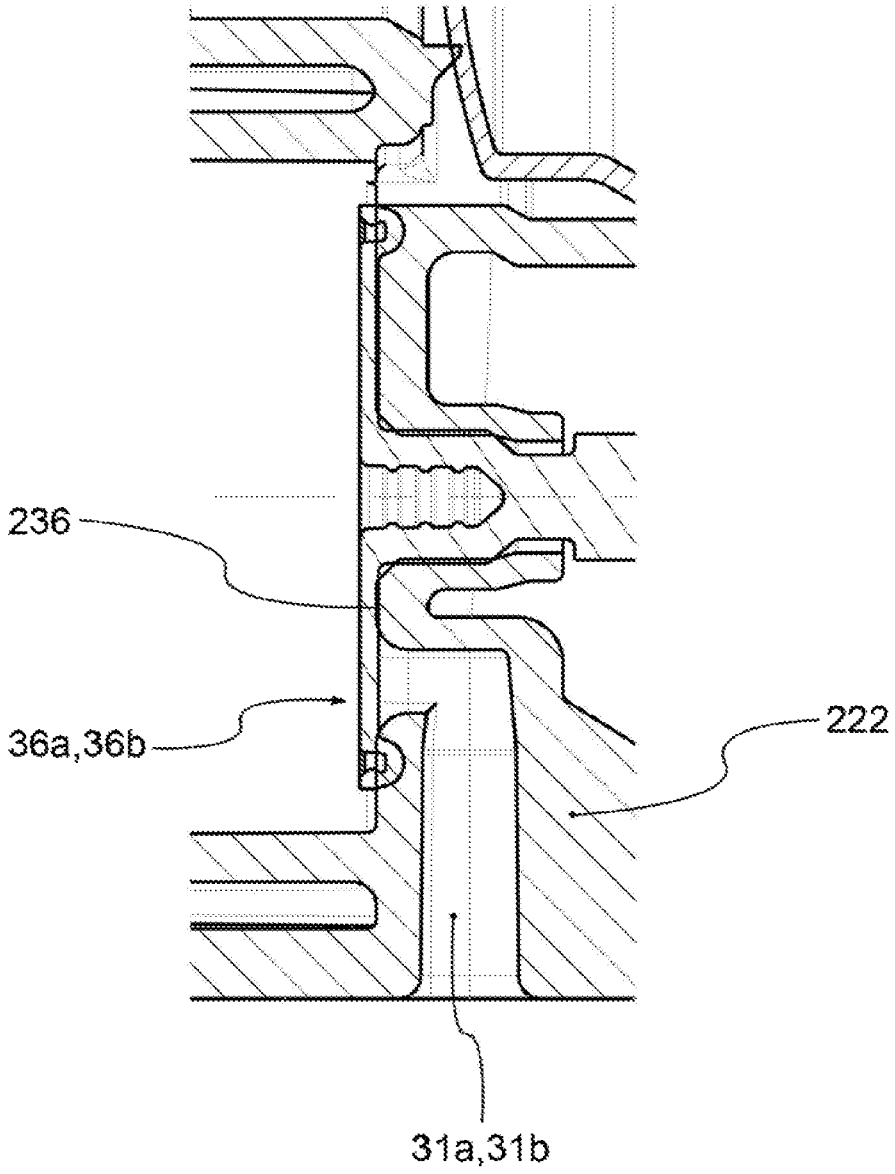
FIG. 11 shows a pre-compression valve of the dispensing head according to a further embodiment of the invention.

For example, according to an embodiment (FIG. 11), the check valve 36*a*,36*b* comprises a flexible membrane 236, affixed to the frame 222.

According to further embodiments, the pre-compression valve comprises a flexible membrane deformable by the action of the threshold pressure in the pressure chamber.

For example, the pre-compression valve 42*a*,42*b* is made in a single piece, for example in plastic, and comprises a deformable membrane 242, for example of a convex shape towards the respective delivery duct 40*a*,40*b*, and a sleeve 244 for positioning in a valve seat 246 of the frame 22.

For example, the sleeve 244 is coupled to the frame 22. According to a variant embodiment, the pre-compression valve means comprise a latch member applicable to the frame to clamp the sleeve to the frame.

What is claimed is:

1. A trigger head for a dispensing device comprising:

a trigger;

at least one pump;

a first delivery duct;

a second delivery duct; and a nozzle group;

wherein the at least one pump is operable by the trigger and suitable for carrying out a predetermined pre-compression of at least two substances, separately and simultaneously before dispensing;

wherein both the first delivery duct and the second delivery duct comprise a flexible tube, and each of the flexible tubes are directly connected to the nozzle group to minimize any premixing of the at least two substances and the flexible tubes have a length suitable to compensate for movement with respect to the nozzle group; and wherein each of the at least one pump comprises at least one pre-compression valve suitable to pass the respective substance from a pressure chamber to the respective delivery duct when the pressure of the respective substance in the pressure chamber exceeds a predefined threshold pressure and suitable to prevent transit of the respective substance from the pressure chamber to the first delivery duct when the pressure of the respective substance in the pressure chamber is less than the predefined threshold pressure.

2. The trigger head of claim 1, wherein the flexible tubes are made of extensible material.

3. The trigger head of claim 1, wherein the first delivery duct and the second delivery duct have different lengths.

4. The trigger head according to claim 1, wherein the predefined pressure threshold is greater than 1 bar.

5. The trigger head according to claim 1, wherein the at least one pre-compression valve comprise a first pre-compression valve, operating between a first pressure chamber and the first delivery duct, and a second pre-compression valve, operating between a second pressure chamber and the second delivery duct.

6. The trigger head according to claim 5, wherein the first pre-compression valve comprises a first obturator plate and the second pre-compression valve comprises a second obturator plate.

7. The trigger head according to claim 5, wherein the first pre-compression valve comprises a first flexible membrane deformable by an action of the predefined threshold pressure in the first pressure chamber and the second pre-compression valve comprises a second flexible membrane deformable by the action of the predefined threshold pressure in the second pressure chamber.

8. A trigger head for a dispensing device comprising:

a trigger;

a pump, operable by the trigger and suitable for carrying out a predetermined pre-compression of at least two substances, comprising: a first substance and a second substance, separately and simultaneously before dispensing;

a first delivery duct;

a second delivery duct;

a nozzle group; and an actuator, operable by the trigger, wherein the actuator comprises a transmission member, hinged to a frame and engageable by the trigger, via an intermediate body;

wherein both the first delivery duct and the second delivery duct comprise a flexible tube, and each of the flexible tubes are directly connected to the nozzle group to minimize any premixing of the at least two substances and the flexible tubes have a length suitable to compensate for movement with respect to the nozzle group; and wherein the pump comprises a pre-compression valve suitable to pass a first substance from a pressure chamber to the first delivery duct when a pressure of the first substance in the pressure chamber exceeds a predefined threshold pressure and suitable to prevent transit of the first substance from the pressure chamber to the first delivery duct when the pressure of the first substance in the pressure chamber is less than the predefined threshold pressure.

9. The trigger head of claim 8, wherein said intermediate body varies in position during pre-compression.

10. The trigger head of claim 9, wherein the transmission member is hinged to a frame at a pivot point so that a rotation of the trigger corresponds to a counter-rotation of the transmission member.

11. The trigger head according to claim 8, wherein the pump comprises a suction valve suitable to allow transit of the first substance from a containment compartment of a bottle of the dispensing device to the pressure chamber in which a piston operates during a suction phase and prevent return of the first substance from the pressure chamber to the containment compartment during a pre-compression step.

12. The trigger head according to claim 11, wherein the suction valve comprises a first check valve, positioned between a first inlet opening and a first pressure chamber; and a second check valve, positioned between a second inlet opening and a second pressure chamber.

13. The trigger head according to claim 12, wherein the first check valve comprises a first obturator sensitive to the action of the first substance present in the first pressure chamber and the second check valve comprises a second obturator sensitive to the action of the second substance present in the second pressure chamber.

14. A trigger head for a dispensing device comprising:

a trigger;

a first pump and a second pump, operable by the trigger and suitable for carrying out a predetermined pre-compression of at least two substances, separately and simultaneously before dispensing;

a first delivery duct;

a second delivery duct;

a nozzle group; and an actuator, operable by the trigger, wherein the actuator comprises a transmission member, hinged to a frame and engageable by the trigger, via an intermediate body;

wherein the first delivery duct and the second delivery duct are separately attached to the nozzle group allowing the two substances to remain separate before entering the nozzle group; and wherein a first delivery duct comprises a first elbow section which extends through the intermediate body, and a second delivery duct comprises a second elbow section which extends through the intermediate body.

15. The trigger head according to claim 14, wherein a first axis of the first pump is positioned behind a second axis of the second pump and in the same plane.

16. The trigger head of claim 14, wherein the first elbow section and the second elbow section have different lengths.

17. The trigger head of claim 14, wherein the first elbow section is positioned above and in the same plane as the second elbow section.

18. The trigger head according to claim 17, wherein the nozzle group attached to the frame and extendible tubes sealingly attached to the nozzle group and to the intermediate body, which define sections of the delivery ducts, the extendible tubes being suitable to offset a position variation between the intermediate body and the nozzle group due to movement undergone by the intermediate body during a pre-compression step.

19. The trigger head of claim 14, wherein a first extendible tube is positioned above and in the same plane as a second extendible tube.

* * * * *